US009728175B2

(12) United States Patent
Strassell

(10) Patent No.: US 9,728,175 B2
(45) Date of Patent: Aug. 8, 2017

(54) INTERCHANGEABLE PICKUP SYSTEM FOR AN ELECTRIC STRINGED MUSICAL INSTRUMENT

(71) Applicant: Andrew James Strassell, Winston Salem, NC (US)

(72) Inventor: Andrew James Strassell, Winston Salem, NC (US)

( * ) Notice: Subject to any disclaimer, the term of this patent is extended or adjusted under 35 U.S.C. 154(b) by 0 days.

(21) Appl. No.: 15/243,020

(22) Filed: Aug. 22, 2016

(65) Prior Publication Data

US 2017/0053631 A1 Feb. 23, 2017

Related U.S. Application Data

(60) Provisional application No. 62/208,640, filed on Aug. 22, 2015.

(51) Int. Cl.

| | |
|---|---|
| ***G10D 3/00*** | (2006.01) |
| ***G10H 3/00*** | (2006.01) |
| ***G10H 3/18*** | (2006.01) |

(52) U.S. Cl.

CPC ..... *G10H 3/181* (2013.01)

(58) Field of Classification Search

USPC ..... 84/726

See application file for complete search history.

(56) References Cited

U.S. PATENT DOCUMENTS

| | | | | |
|---|---|---|---|---|
| 4,425,831 A | | 1/1984 | Lipman | |
| 4,854,210 A | | 8/1989 | Palazzolo | |
| 5,252,777 A | * | 10/1993 | Allen | G10H 3/182 84/726 |
| 5,614,688 A | * | 3/1997 | Donnell | G10H 3/181 84/743 |
| 5,767,432 A | * | 6/1998 | Randolph | G10D 1/085 84/267 |
| 6,111,184 A | | 8/2000 | Cloud et al. | |
| 8,178,774 B2 | | 5/2012 | Salehi | |
| 8,455,750 B1 | * | 6/2013 | Severson | G10H 3/183 84/743 |
| 8,471,137 B2 | | 6/2013 | Adair et al. | |
| 8,680,389 B2 | * | 3/2014 | Yamanaka | G10H 3/181 84/723 |
| 2009/0249946 A1 | * | 10/2009 | Hunter | G10H 3/183 84/726 |
| 2015/0356966 A1 | | 12/2015 | Yano | |

* cited by examiner

*Primary Examiner* — Christopher Uhlir

(74) *Attorney, Agent, or Firm* — Dunlap Bennett & Ludwig, PLLC

(57) ABSTRACT

A guitar body having an inner sidewall forming an opening extending from a front to a back of the guitar body is provided. The inner sidewall includes electrical contacts electrically connected to a wiring of the guitar. A seat with magnets is formed about a periphery of the inner sidewall. A pickup cartridge includes a pickup, electrical contacts, and a flange with magnets. The opening is sized to receive the pickup cartridge so that the magnets of the seat attract to the magnets of the flange and releasably retain the pickup cartridge within. The electrical contacts of the pickup cartridge electrically connect with the electrical contacts of the inner sidewall.

10 Claims, 4 Drawing Sheets

INTERCHANGEABLE PICKUP SYSTEM FOR AN ELECTRIC STRINGED MUSICAL INSTRUMENT

CROSS-REFERENCE TO RELATED APPLICATION

This application claims the benefit of priority of U.S. provisional application No. 62/208,640, filed Aug. 22, 2015, the contents of which are herein incorporated by reference.

BACKGROUND OF THE INVENTION

The present invention relates to electric guitar transducer mountings and, more particularly, to an improved mounting for a transducer permitting ready removal and interchange of transducers in an electric guitar.

Transducers, also known as pickups, have conventionally been mounted in electric guitars so as to convert the vibration in the guitar string into an electrical signal which may thereafter be amplified or otherwise modulated as desired. Such transducers are conventionally mounted in the guitar body by positioning the transducer in an opening arranged beneath the strings on the front of the guitar body. Exchange or replacement of the transducer requires loosening of the strings to permit them to be moved away from the opening in the front of the guitar body, so as to provide access to the transducer. Thereafter, removal of the transducer generally requires desoldering of the connecting wires, and replacement requires resoldering of wires, resecurement of the transducer, and retuning of the guitar. Since different transducers may produce different effects, many musicians will employ different transducers in the same guitar body, and when purchasing a transducer, will try out a number of different transducers to determine which produces what is for them the most desired effect. This replacement and interchange of transducers is obviously cumbersome and time consuming.

As can be seen, there is a need for an improved mounting for a transducer permitting ready removal and interchange of transducers in an electric guitar.

SUMMARY OF THE INVENTION

In one aspect of the present invention, a guitar comprises: a guitar body comprising an inner sidewall forming an opening extending from a front to a back of the guitar body, wherein the inner sidewall comprises electrical contacts electrically connected to a wiring of the guitar, and a seat is formed about a periphery of the inner sidewall, the seat comprising a plurality of magnets; a pickup cartridge comprising a pickup housing secured to a pickup base plate, wherein a pickup is secured to and extending from an opening formed at a top of the pickup housing, electrical contacts are electrically connected to the pickup and disposed at an outer surface of the pickup housing, and the base plate forms a flange about a periphery, wherein the flange comprises a plurality of magnets, wherein the opening is sized to receive the pickup cartridge so that the magnets of the seat attract to the magnets of the flange and releasably retain the pickup cartridge within, and the electrical contacts of the pickup cartridge electrically connect with the electrical contacts of the inner sidewall.

In another aspect of the present invention, a guitar comprises: a guitar body comprising an inner sidewall forming an opening extending from a front to a back of the guitar body, wherein the inner sidewall comprises electrical contacts electrically connected to a wiring of the guitar, and a seat is formed about a periphery of the inner sidewall, the seat comprising a plurality of magnets; a pickup cartridge comprising a pickup housing secured to a pickup base plate, wherein a pickup is secured to and extending from an opening formed at a top of the pickup housing, electrical contacts are electrically connected to the pickup and disposed at an outer surface of the pickup housing, and the base plate forms a flange about a periphery, wherein the flange comprises a plurality of magnets and a pair of finger openings formed on opposing sides, wherein each of the finger openings is sized to fit at least a portion of a finger within, wherein the opening is sized to receive the pickup cartridge so that the magnets of the seat attract to the magnets of the flange and releasably retain the pickup cartridge within, and the electrical contacts of the pickup cartridge electrically connect with the electrical contacts of the inner sidewall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claim.

Figure 1:
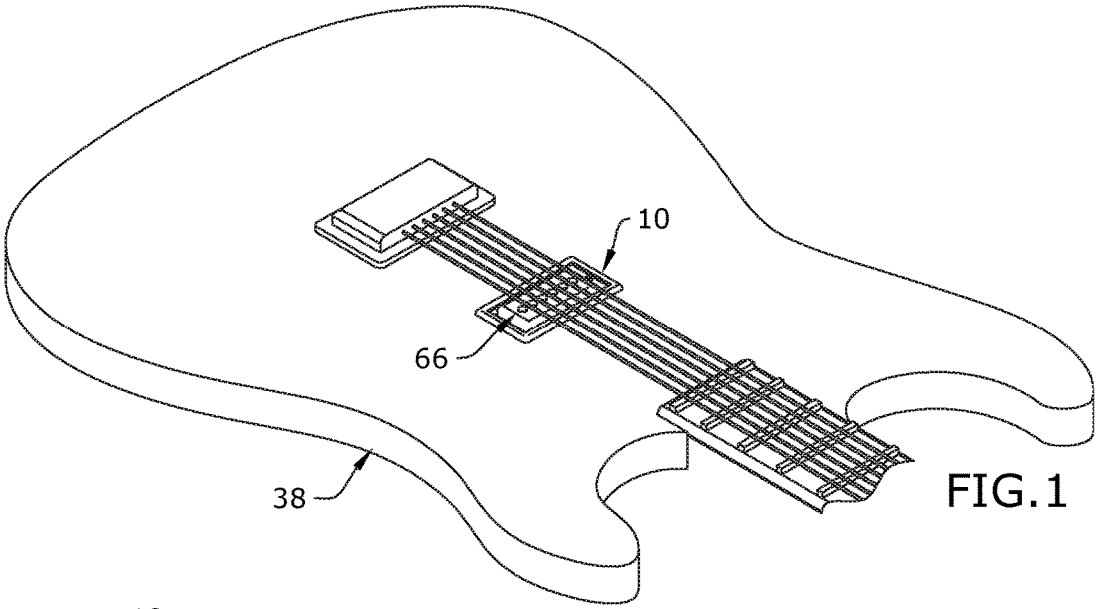
FIG. 1 is a top detail perspective view of the present invention shown in use.
Figure 2:
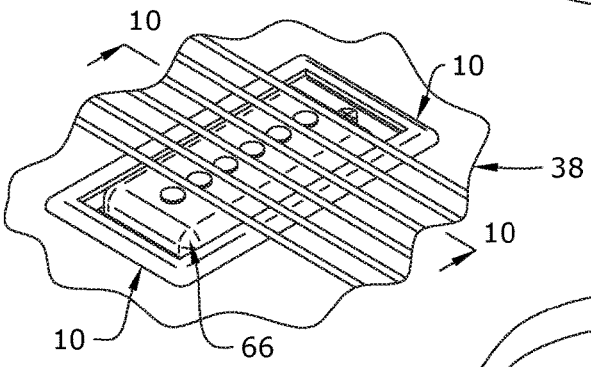
FIG. 2 is a top detail perspective view of the present invention shown in use.
Figure 3:
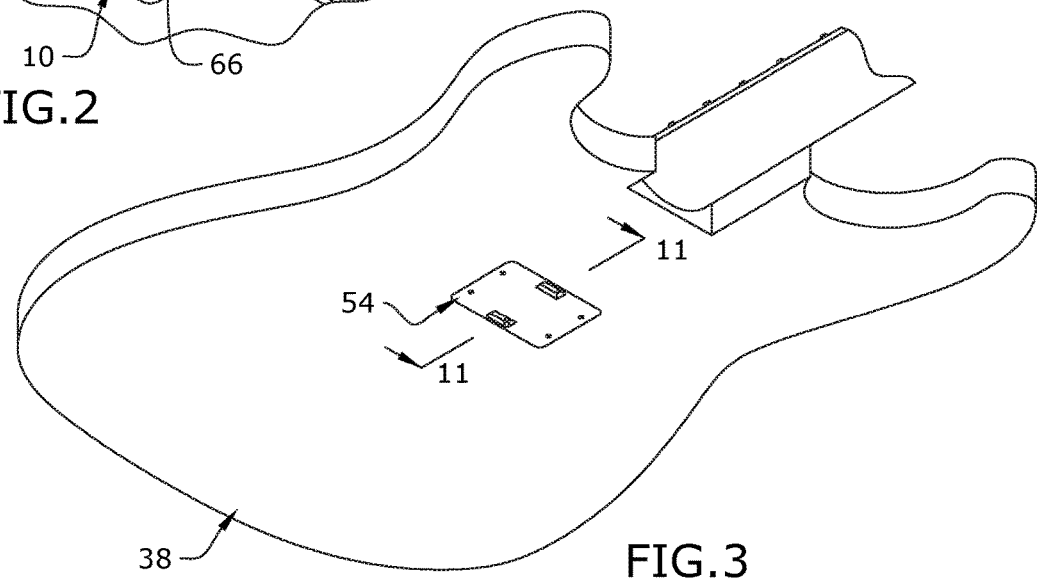
FIG. 3 is a bottom detail perspective view of the present invention shown in use.
Figure 5:
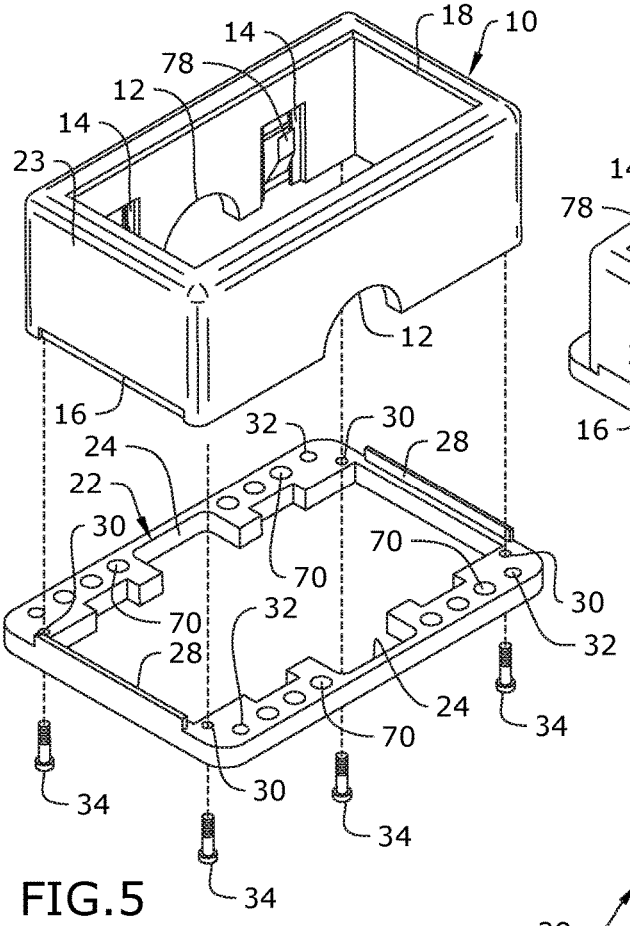
FIG. 5 is an exploded view of the present invention assembly component.
Figure 4:
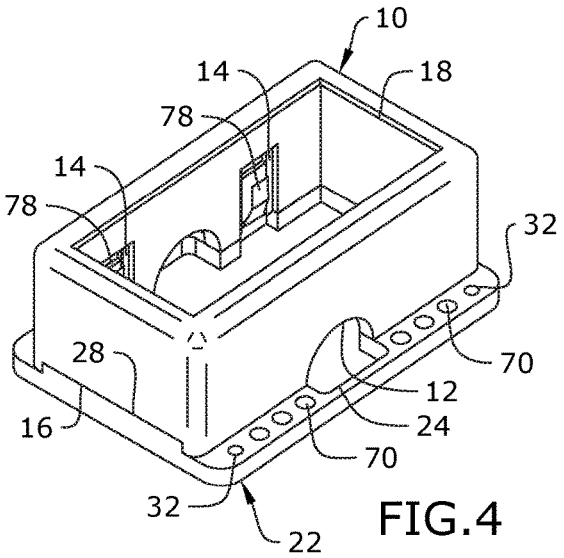
FIG. 4 is a perspective view of the present invention assembly component.
Figure 6:
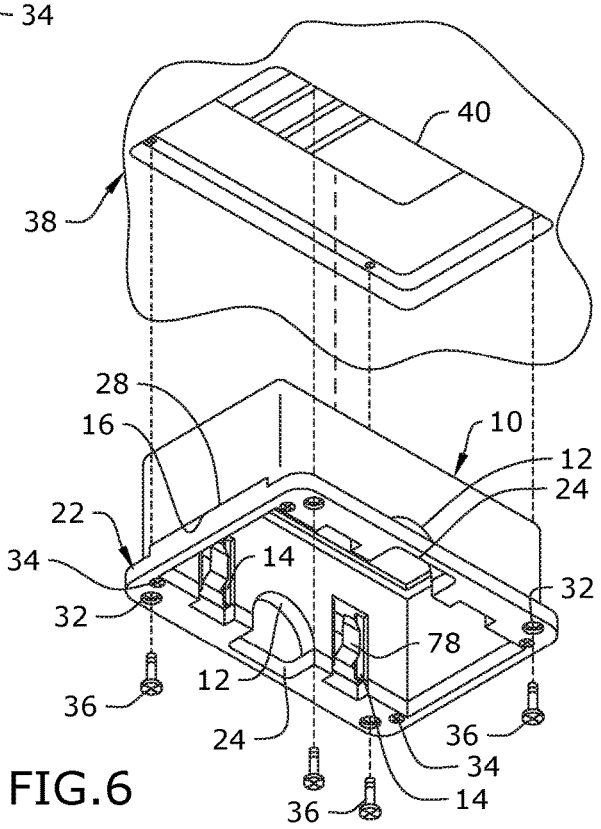
FIG. 6 is an exploded view of the present invention assembly component show in insertion.
Figure 7:
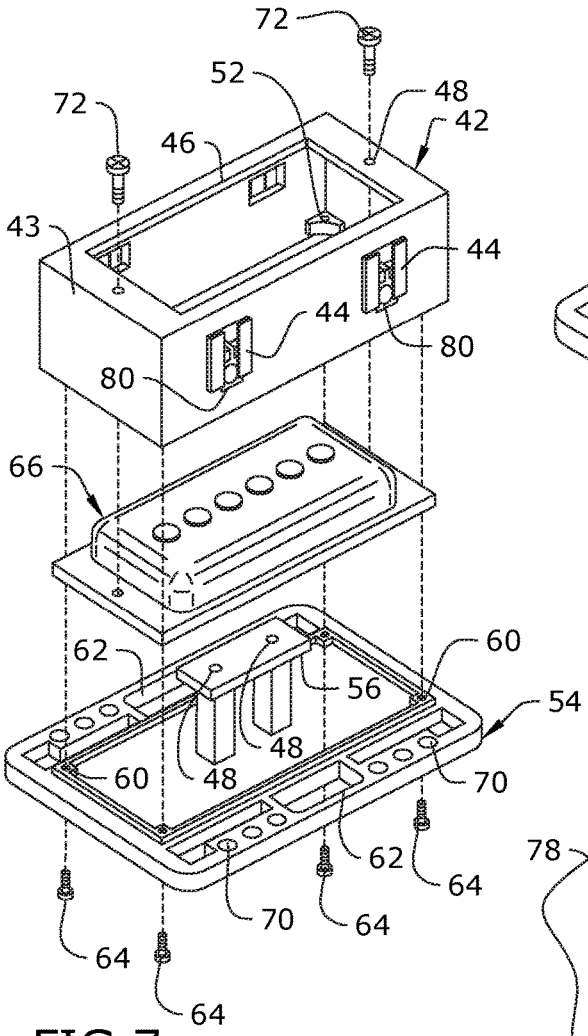
FIG. 7 is an exploded view of the present invention assembly component.
Figure 8:
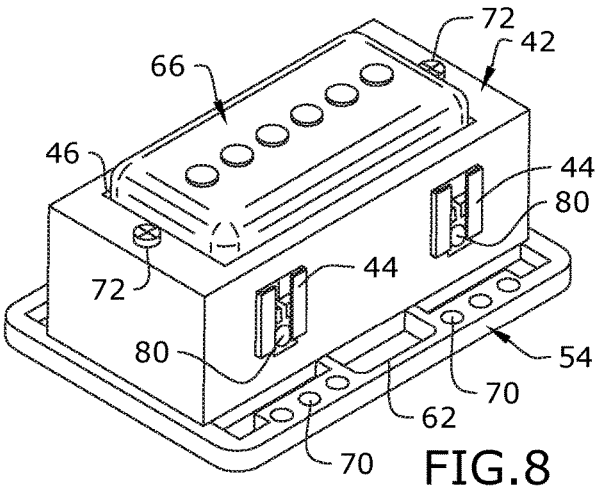
FIG. 8 is a perspective view of the present invention assembly component.
Figure 9:
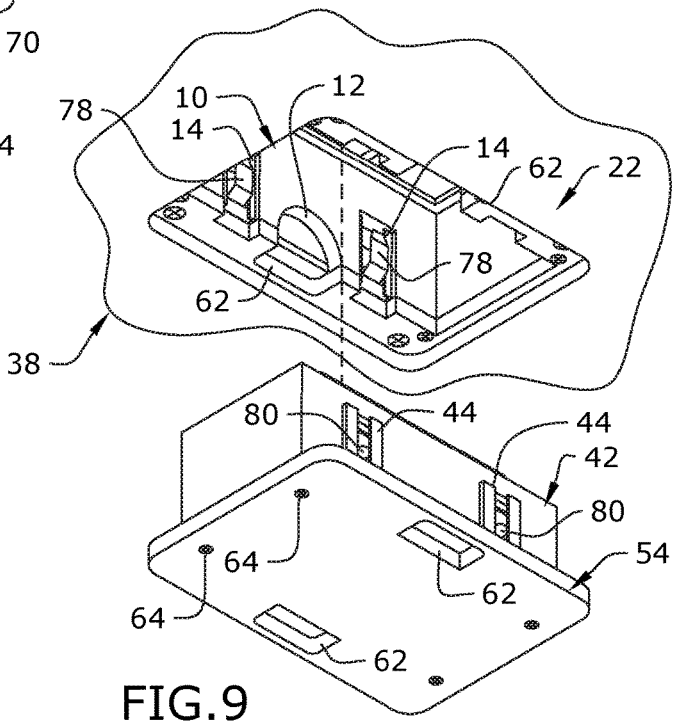
FIG. 9 is an exploded view of the present invention assembly component show in insertion.
Figure 10:
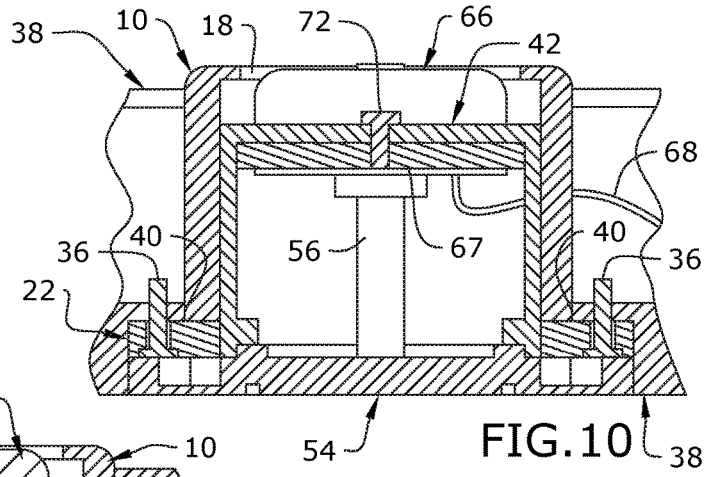
FIG. 10 is a section detail view of the present invention taken along line 10-10 in FIG. 2.
Figure 11:
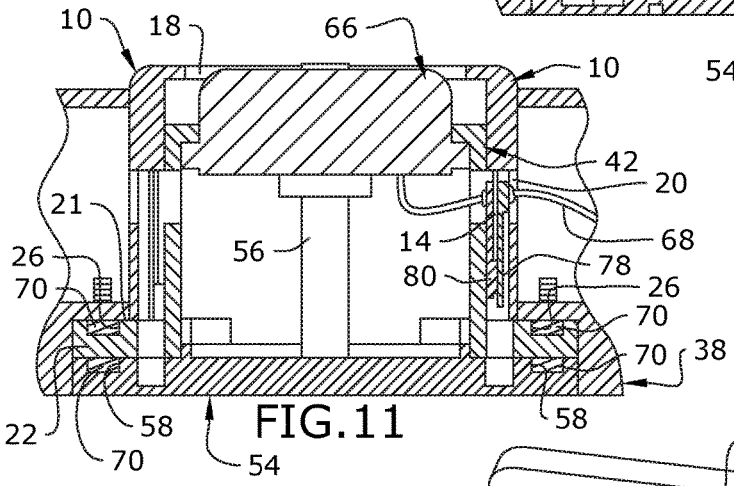
FIG. 11 is a section detail view of the present invention taken along line 11-11 in FIG. 3.
Figure 12:
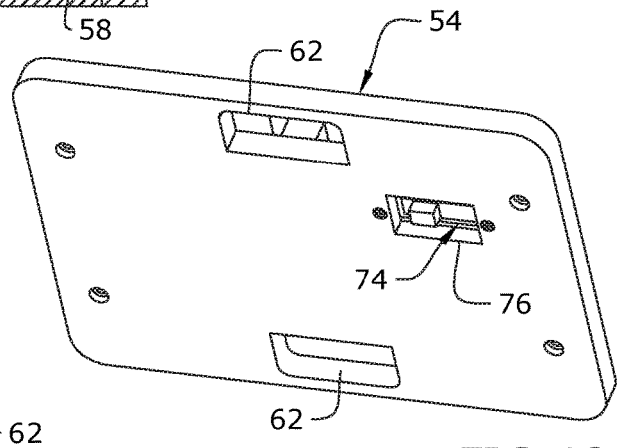
FIG. 12 is a bottom perspective view of an alternate embodiment of the present invention.
Figure 13:
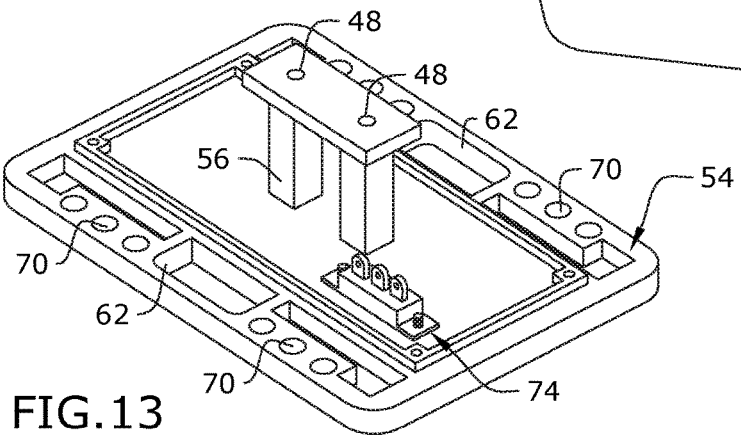
FIG. 13 is a top perspective view of an alternate embodiment of the invention.

Referring to FIGS. 1 through 11, the present invention includes an electrical guitar 38 having a body and with a fretted fingerboard. The particular shape of the guitar body, neck, head and fingerboard can be of any desired configuration, as will be understood by those skilled in the art.

The guitar body includes a front surface, a back surface and an inner sidewall forming an opening 40 extending from the front surface to the back surface of the guitar body. The inner sidewall includes first electrical contacts 78 electrically connected to a wiring 68 of the guitar 38. A seat 21 is formed about a periphery of the inner sidewall and protrudes inwards within the opening. The seat includes a seat surface facing the back surface of the guitar body. The seat 21 includes plurality of magnets 70. A pickup cartridge 42 includes a pickup housing 43 secured to a pickup base plate 54. A pickup 66 is secured to the pickup cartridge and extends from an opening 46 formed at a top of the pickup housing 43. Second electrical contacts 80 are electrically connected to the pickup 66 and are disposed at an outer surface of the pickup housing 43. The base plate 54 forms a flange about a periphery. The flange includes a plurality of magnets 70. The opening 40 is sized to receive the pickup cartridge 42 so that the flange of the base plate 54 abuts the seat surface. The magnets 70 of the seat 21 attract to the magnets 70 of the flange and releasably retain the pickup cartridge 42 within the opening of the guitar body. The second electrical contacts 80 of the pickup cartridge electrically connect with the first electrical contacts 78 of the inner sidewall.

In certain embodiments, the present invention may include a cartridge chamber 10. The cartridge chamber 10 includes a chamber housing 23 and a chamber base plate 22. The cartridge chamber 10 is fixedly secured within the opening 40 of the guitar body. The chamber housing 10 includes sidewalls having an inner and outer surface. Contact holders 14 are formed through the sidewalls so that the first electrical contacts 78 may protrude through. The sidewalls may also include finger openings 12 formed at a lower edge. The top end of the chamber housing 23 includes an opening 18 sized to receive the pickup 66 therethrough. The bottom end forms an opening and includes an index slot 16.

The chamber base plate 22 includes an opening that aligns with the opening of the chamber housing 23 formed at the bottom end. An upper surface of the chamber base plate 22 may include plate lips 28 that mate with the index slots 16. The chamber base plate 22 is secured to the cartridge chamber 10 by fasteners 34 running through aligning openings 30. The chamber base plate 22 may further include finger openings 24 that align with the figure openings 12 of the chamber housing 23. In certain embodiments, the entire periphery of the chamber base plate 22 may form the seat 21. In such embodiments, a plurality of magnet slots 26 are formed through the chamber base plate 22. The magnets 70 fit and are retained within the magnet slots 26. The chamber base plate 22 is fixed to the guitar 38 by fasteners 36 running through aligning openings 32.

The pickup cartridge 42 includes a pickup housing 43 that is sized to fit through the opening formed in the chamber base plate 22 and into the chamber housing 23. The pickup housing 43 includes the openings 46 formed at the top end. The pickup 66 fits within and protrudes form the opening 46. The pickup housing 43 includes sidewalls having an inner and outer surface. Contact holders 44 secure the second electrical contacts 80 of the pickup 66 within. The pickup 66 may be secured to the top end by fasteners 72 running through aligning apertures 48.

The pickup base plate 54 may include a substantially flat plate having an upper surface and a lower surface. A plate stand 56 may extend from a center portion of the upper surface of the pickup base plate 54. The plate stand 56 may support the pickup 66. Foam 67 may be disposed in between the pickup 66 and the plate stand 56. By placing the foam 67 on the underside of the pickup 66 and applying slight pressure to it, the pickup 66 vibrates less under the guitar's strings, which in turn creates a stronger output of the pickup 66. The pickup base plate 54 may further include finger openings 62 formed through a periphery on opposing sides. The finger openings 62 allow users to easily grasp the pickup cartridge 42 and remove it from the guitar 38. Magnet slots 58 are formed about the periphery of the pickup base plate 54 with magnets 70 secured within. The pickup housing 43 connects to the pickup base plate 54 via fasteners 64 running through aligning housing apertures 52 and base plate apertures 60.

In certain embodiments, the present invention may further include a switch 74 protruding from the lower surface of the pickup base plate 54. The switch 74 fits within a switch recess 76 formed through the pickup base plate 54. The switch 74 reconfigures wiring within the pickup cartridge 42 whereby electricity may be diverted from a direct connect to the pickup 66 to a 9V battery thus creating a more sensitive and higher output pickup 66.

It should be understood, of course, that the foregoing relates to exemplary embodiments of the invention and that modifications may be made without departing from the spirit and scope of the invention as set forth in the following claims.

What is claimed is:

1. A guitar comprising:

a guitar body comprising a front surface, a back surface and an inner sidewall forming an opening extending from the front surface to the back surface of the guitar body, wherein the inner sidewall comprises first electrical contacts electrically connected to a wiring of the guitar, and a seat formed about a periphery of the inner sidewall and protruding inwards within the opening, wherein the seat comprises a seat surface facing the back surface of the guitar body, the seat comprising a plurality of magnets;

a pickup cartridge comprising a pickup housing secured to a pickup base plate, wherein a pickup is secured to the pickup cartridge and extending from an opening formed at a top of the pickup housing, second electrical contacts are electrically connected to the pickup and disposed at an outer surface of the pickup housing, and the pickup base plate forms a flange about a periphery, wherein the flange comprises a plurality of magnets, wherein the pickup cartridge is disposed within the opening so that the flange is proximal to the seat surface and the magnets of the seat attract to the magnets of the flange and releasably retain the pickup cartridge within the opening, the second electrical contacts of the pickup cartridge electrically connect with the first electrical contacts of the inner sidewall, the pickup base plate is disposed at the back surface of the guitar body and the pickup is extending from the opening of the guitar body at the front surface of the guitar body.

2. The guitar of claim 1, further comprising a cartridge chamber fixedly secured within the opening, wherein the cartridge chamber comprises a cartridge chamber housing comprising the first electrical contacts, and a chamber base plate, wherein the seat is formed by a periphery of the chamber base plate, wherein the pickup housing is disposed within the cartridge chamber housing and the pickup protrudes through an opening formed at a top of the cartridge chamber housing.

3. The guitar of claim 1, wherein the pickup cartridge further comprises a plate stand disposed in between the pickup and the pickup base plate, wherein the plate stand supports the pickup.

4. The guitar of claim 3, wherein the pickup cartridge further comprises a foam layer disposed in between the plate stand and the pickup.

5. The guitar of claim 1, wherein the pickup cartridge further comprises a switch extending from an outer surface of the pickup base plate.

6. The guitar of claim 1, wherein the flange of the pickup base plate comprises a pair of finger openings formed on opposing sides, wherein each of the finger openings is sized to fit at least a portion of a finger within.

7. A guitar comprising:

a guitar body comprising a front surface, a back surface and an inner sidewall forming an opening extending from the front surface to the back surface of the guitar body;

a cartridge chamber fixedly secured to the guitar body within the opening, wherein the cartridge chamber comprises a cartridge chamber housing comprising first electrical contacts electrically connected to a wiring of the guitar, and a chamber base plate, wherein a seat is formed by a periphery of the chamber base plate, the seat comprising a plurality of magnets and a seat surface facing the back surface of the guitar body;

a pickup cartridge comprising a pickup housing secured to a pickup base plate, wherein a pickup is secured to and extending from an opening formed at a top of the pickup housing, second electrical contacts are electrically connected to the pickup and disposed at an outer surface of the pickup housing, and the pickup base plate forms a flange about a periphery, wherein the flange comprises a plurality of magnets and a pair of finger openings formed on opposing sides, wherein each of the finger openings is sized to fit at least a portion of a finger within, wherein the pickup housing is disposed within the cartridge chamber housing so that the flange is proximal to the seat surface and the magnets of the seat attract to the magnets of the flange and releasably retain the pickup cartridge within the cartridge chamber, the second electrical contacts of the pickup cartridge electrically connect with the first electrical contacts of the cartridge chamber housing, the pickup base plate is disposed at the back surface of the guitar body and the pickup is extending through an opening formed at a top of the cartridge chamber housing and from the opening of the guitar body at the front surface of the guitar body.

8. The guitar of claim 7, wherein the pickup cartridge further comprises a plate stand disposed in between the pickup and the pickup base plate, wherein the plate stand supports the pickup.

9. The guitar of claim 8, wherein the pickup cartridge further comprises a foam layer disposed in between the plate stand and the pickup.

10. The guitar of claim 7, wherein the pickup cartridge further comprises a switch extending from an outer surface of the pickup base plate.

* * * * *